US009745993B2

(12) United States Patent
Stone et al.

(10) Patent No.: US 9,745,993 B2
(45) Date of Patent: Aug. 29, 2017

(54) SEALING DEVICE FOR AN IMMERSIBLE PUMP

(75) Inventors: Jon Terence Stone, Clemmons, NC (US); Gary A. Moren, Advance, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 787 days.

(21) Appl. No.: 13/159,161

(22) Filed: Jun. 13, 2011

(65) Prior Publication Data

US 2012/0315162 A1 Dec. 13, 2012

(51) Int. Cl.
*F04D 29/10* (2006.01)
*F04D 13/08* (2006.01)

(52) U.S. Cl.
CPC ..... *F04D 29/106* (2013.01); *F04D 13/08* (2013.01); *Y10T 29/49243* (2015.01)

(58) Field of Classification Search
CPC ..... F04D 29/043
USPC ..... 417/360, 423.1, 423.11, 424.1, 572; 464/179–185, 170, 277, 338, 339; 277/500
See application file for complete search history.

(56) References Cited

U.S. PATENT DOCUMENTS 1,893,921 A * 1/1933 Wintroath ..... 384/368
2,002,915 A * 5/1935 Mendenhall et al. ..... 310/87
2,218,003 A * 10/1940 Hawley, Jr. ..... H02K 5/132 310/87
2,369,282 A * 2/1945 Curtis et al. ..... 222/333
2,939,400 A * 6/1960 Maynard ..... 417/423.3
2,977,138 A * 3/1961 Brittain, Jr. ..... 277/552
3,104,459 A * 9/1963 Wendt ..... 29/252
3,369,715 A * 2/1968 Carter ..... 222/333
3,531,216 A * 9/1970 Callahan ..... 416/244 R
6,990,708 B2 * 1/2006 Rosa et al. ..... 15/320
2004/0171427 A1 * 9/2004 Wagner ..... F16D 3/385 464/131
2011/0194956 A1 * 8/2011 Royzen ..... 417/414

OTHER PUBLICATIONS

Immersible Pump Owner's Manual (Jan. 2005) (10 pages).

* cited by examiner

*Primary Examiner* — Devon Kramer
*Assistant Examiner* — Lilya Pekarskaya
(74) *Attorney, Agent, or Firm* — McCarter & English, LLP

(57) ABSTRACT

Disclosed herein is an apparatus for an immersible pump. The apparatus can include a shaft for communicating with a motor. The shaft includes a first region having a first diameter, a second region having a second diameter that is less than the first diameter, and a tapering region between the two regions. A sleeve can be provided to receive the shaft. A sealing device includes a receiving area in which the tapering region is at least partially positionable to form a seal, and an abutment that is configured to form a seal with the sleeve and that is responsive to a force directed from the sleeve to enhance the seal with the tapering region. In some embodiments, the sealing device is provided with a circumferential outer wall for centering the sleeve about the shaft and/or for aligning the force with the abutment.

35 Claims, 8 Drawing Sheets

SEALING DEVICE FOR AN IMMERSIBLE PUMP

FIELD OF THE INVENTION

The present invention relates generally to a shaft sealing device, and, more specifically, to a sealing device that is compressible between a shaft and a shaft sleeve for restricting fluidic access between the shaft and the shaft sleeve.

BACKGROUND OF THE INVENTION

Immersible pumps known in the art are utilized to pump fluid from a fluid source. Often, the fluid being pumped contains corrosive liquid chemicals. At least for reasons due to the corrosive nature of the fluid, it is desirous to keep the fluid away from metal components of the immersible pump, such as the shaft, for example. To achieve this, a non-metal sleeve is provided to cover the shaft and thus protect it from contacting the corrosive fluid. However, a small space remains between the shaft and the sleeve where fluid may enter. The prior art includes the use of an o-ring in an effort to restrict fluid entry. For example, reference is made to the prior art pump 500 of FIG. 11. The prior art pump 500 includes a motor 502, a housing 504, a shaft 506, a sleeve 508, and an impeller 510. The shaft 506 includes a motor engaging component 514, an enlarged hollow attachment component 516, and an extension component 518. An o-ring 512 and the shaft sleeve 508 are placed over the extension component 518 until the o-ring 512 abuts the enlarged attachment component 516, and the impeller 510 is tightened to force the sleeve 508 to compress the o-ring 512 against the enlarged attachment component 516. The o-ring 512 inhibits the entry of fluid into space between the shaft 506 and the sleeve 508. What is desirable in the art, however, is a means for providing an enhanced seal.

SUMMARY OF THE INVENTION

The present invention overcomes the disadvantages and shortcomings of the prior art by providing a sealing device for an immersible pump and methods of manufacture thereof.

In some embodiments, an apparatus is provided that includes a shaft for communicating with a motor, wherein the shaft includes a first region having a first diameter, a second region having a second diameter that is less than (e.g., skinnier than) the first diameter, and a tapering region between the two regions. The apparatus may also include a sleeve having a bore configured to receive the shaft, and a sealing device. The sealing device can include a receiving area configured so that the tapering region of the shaft is positionable at least partially therein to form a seal therewith, and can further include an abutment that is configured to form a seal with the sleeve and that is responsive to a force directed from the sleeve to enhance the seal with the tapering region. The sealing device can have a circumferential outer wall positionable proximal the sleeve. The circumferential outer wall is preferably provided as a cylindrical wall, though it can be provided as a pseudo-cylindrical wall (e.g., rectilinear, octagonal, etc.) with geometry complementary to the shaft and sleeve. In some embodiments, the abutment may be formed by an annular ring, positioned between the receiving area and the circumferential outer wall, and having a radially-extending shoulder. In some embodiments, the circumferential outer wall can be positionable with a gap between the second region and the sleeve so as to direct a load on the sealing device from the force to said shoulder. In some embodiments, the circumferential outer wall of the sealing device can aid in centering the sleeve about the shaft and/or aligning the force against the abutment. In some embodiments, the shaft has a first end positionable proximal the sealing device and a second end opposite the first end, and the sleeve has a first end positionable proximal the sealing device and a second end opposite the first end. An impeller can be provided that may be securable to the second end of the shaft against the second end of the sleeve. The impeller may be securable to the second end of the shaft so as to force the second end of the sleeve toward the abutment, or the impeller may be threadably engageable with the second end of the shaft so as to force the sleeve in a direction toward the abutment. Some embodiments of the immersible pump are provided at least partially disassembled in the form of a kit.

In some embodiments, an apparatus for use with an immersible pump includes a sealing device including a first sealing means for forming a seal with a tapering region of a shaft communicable with a motor, and a second sealing means for forming a seal with a sleeve configured to have the shaft extend therethrough and for enhancing the seal of the first sealing means in response to a force directed at least in part from the sleeve.

In some embodiments, a method is provided for assembling a submersible pump wherein a shaft is provided having a first region having a first diameter, a second region having a second diameter less than the first diameter, and a tapering region therebetween. A sleeve with a first end and a second end opposite the first end, and a sealing device including a receiving area configured to have the tapering region at least partially positioned therein and an abutment, are also provided. The shaft is inserted into the receiving area of the sealing device and into the first end of the sleeve. The first end of the sleeve is caused to direct a force toward the abutment so as to seal the receiving area with the tapering region at least partially positioned therein and at least partially seal the sleeve. In some embodiments, causing the first end of the sleeve to direct the force toward the abutment can comprise forcing the second end of the sleeve in a direction toward the abutment. In some embodiments, forcing the second end of the sleeve in the direction toward the abutment can comprise forcing the second end of the sleeve in the direction toward the abutment by attaching an impeller to the shaft. In some embodiments, attaching an impeller to the shaft can comprise threading the impeller to an end of the shaft proximal the second end of the sleeve. In some embodiments, the sealing device can be provided to include a circumferential outer wall. In such embodiments, the shaft can be inserted into the circumferential outer wall and the circumferential outer wall can be positioned between the shaft and the sleeve to center the sleeve about the shaft and/or to align the force with the abutment.

Additional features, functions and benefits of the disclosed sealing device and methods and apparatus in connection therewith will be apparent from the detailed description which follows, particularly when read in conjunction with the accompanying figures.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE INVENTION

Figure 1:
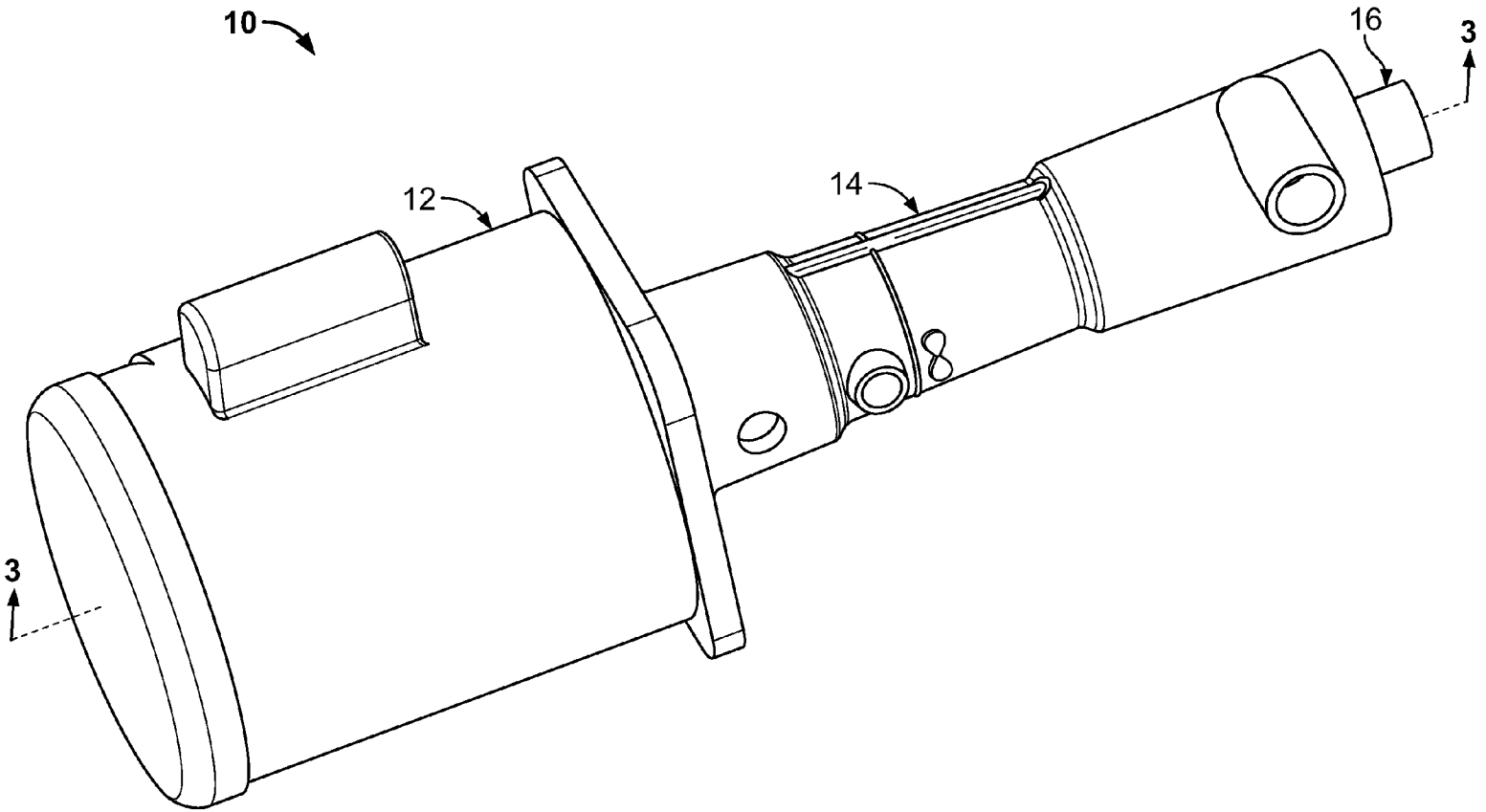
FIG. 1 is a perspective view of an immersible pump constructed in accordance with an embodiment of the present invention, the immersible pump being shown to include a motor, an impeller housing, and an end cap.
Figure 2:
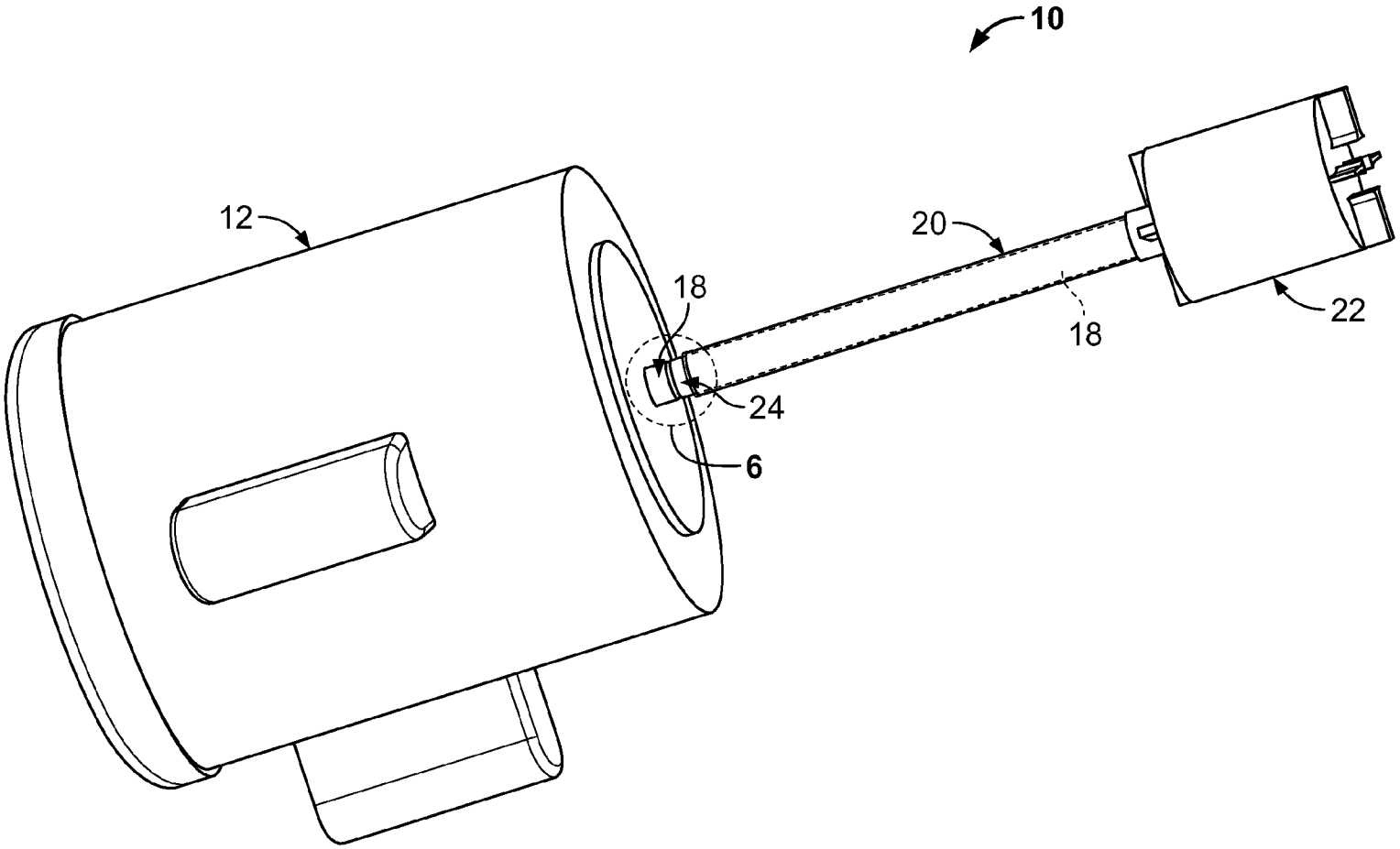
FIG. 2 is a perspective view of the immersible pump of FIG. 1 with the impeller housing having been removed to show a shaft, a shaft sleeve, an impeller, and a sealing device of the immersible pump.
Figure 3:
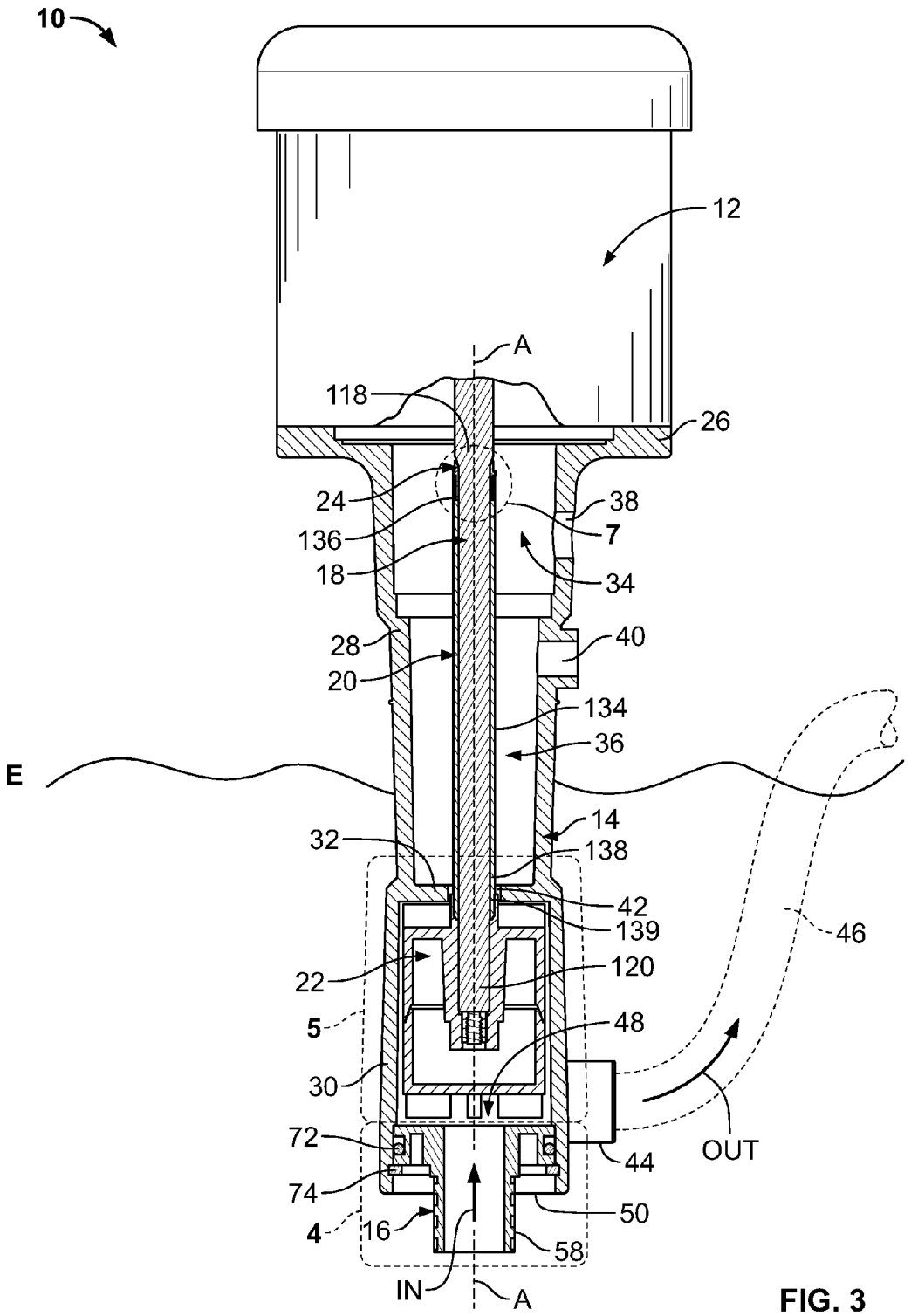
FIG. 3 is a sectional view of the immersible pump of FIGS. 1 and 2 taken along section line 3-3 of FIG. 1.

Referring to FIGS. 1-3, an immersible pump 10 is shown constructed in accordance with an exemplary embodiment of the present invention. The use of the word immersible should not be construed as requiring the reference device to be fully submerged in fluid. The immersible pump 10 includes a motor 12, an impeller housing 14, an end cap 16, a shaft 18, a shaft sleeve 20, an impeller 22, and a sealing device 24, each of which will be discussed with further detail below.

Referring to FIG. 3, the immersible pump 10 includes the impeller housing 14. The impeller housing 14 can be generally monolithic in form and includes an end plate 26, a first portion 28, a second portion 30, and a division wall 32 separating the first portion 28 and the second portion 30. The first portion 28 generally forms a first shaft chamber 34 and a second shaft chamber 36 for substantially housing a portion of the shaft 18, the shaft sleeve 20, and the sealing device 24. Extending through a wall of the first portion 28 are an access hole 38 and a drain hole 40, which will be discussed in greater detail below. The division wall 32 is generally provided between the first portion 28 and the second portion 30, and includes a through-hole 42 which permits the shaft 18 and the shaft sleeve 20 to extend from the first portion 28 to the second portion 30. The second portion 30 generally includes an outlet 44 formed on the exterior and extends tangentially therefrom. The outlet 44 permits fluid to flow outward from the second portion 30. Optionally, a hose 46 or other conduit such as a pipe may be connected to the outlet 44 for facilitating the removal of fluid. The second portion 30 further forms an impeller chamber 48 which substantially houses the impeller 22, the end cap 16, a portion of the shaft 18 and a portion of the shaft sleeve 20. The impeller chamber 48 is substantially divided from the second shaft chamber 36 by the division wall 32.

Figure 4:
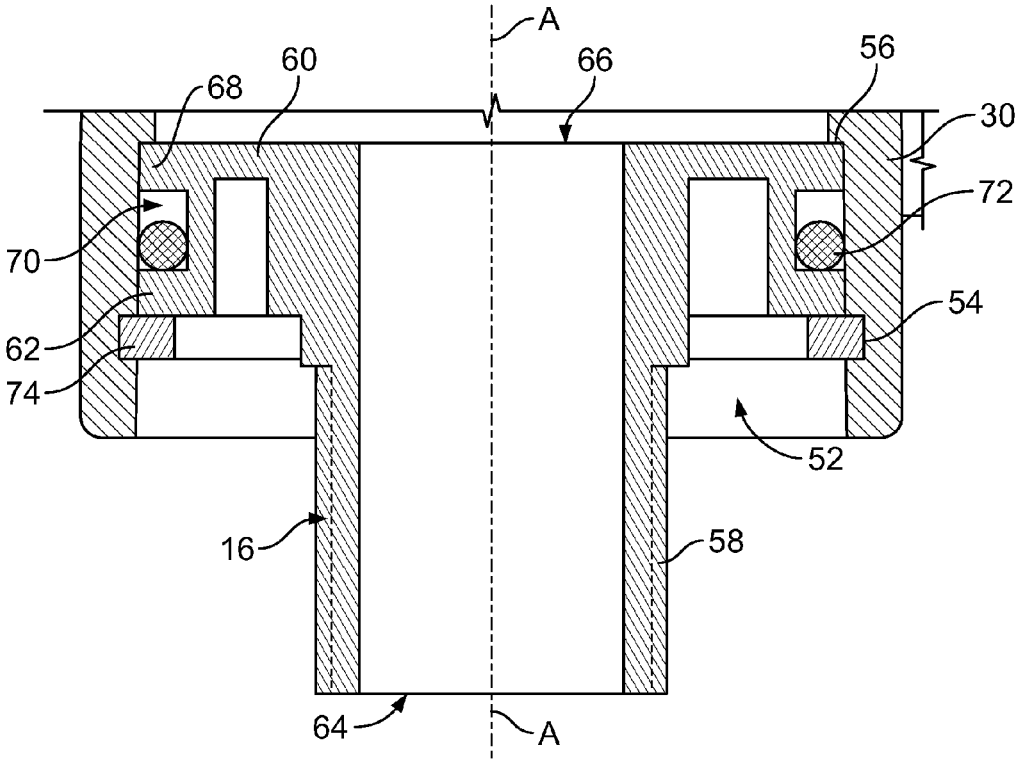
FIG. 4 is a sectional view of the end cap and impeller housing of FIGS. 1-3 showing an enlargement of area 4 of FIG. 3.

Referring to FIGS. 3-4, the second portion 30 further defines an opening 50, and includes a counter bore 52 and a circumferential recess 54. The counter bore 52 forms a radial shoulder 56. Housed in the second portion 30 is the end cap 16, which includes a tubular region 58, an annular flange 60 and an L-shaped extension 62. The tubular region 58 defines an inlet 64 and an outlet 66. The annular flange 60 extends radially outward from the tubular region 58 and includes an extension 68 extending from an intermediate point along the annular flange 60. The annular flange 60 further includes an L-shaped extension 62 which extends from the intermediate point along the annular flange 60. The L-shaped extension 62 cooperates with the extension 68 to form a chamber 70 which houses an o-ring 72 that seals the end cap 16 against the impeller housing 14. When the end cap 16 is housed in the second portion 30 of the housing 14, the extension 68 engages the radial shoulder 56 of the second portion 30. A snap ring 74 can be snapped into the circumferential recess 54 of the second portion to secure the end cap 16 within the second portion 30. The inlet 64 and the outlet 66 allow fluid to flow through the end cap 16 and into the impeller chamber 48 so that the impeller 22 can act on the fluid.

Figure 5:
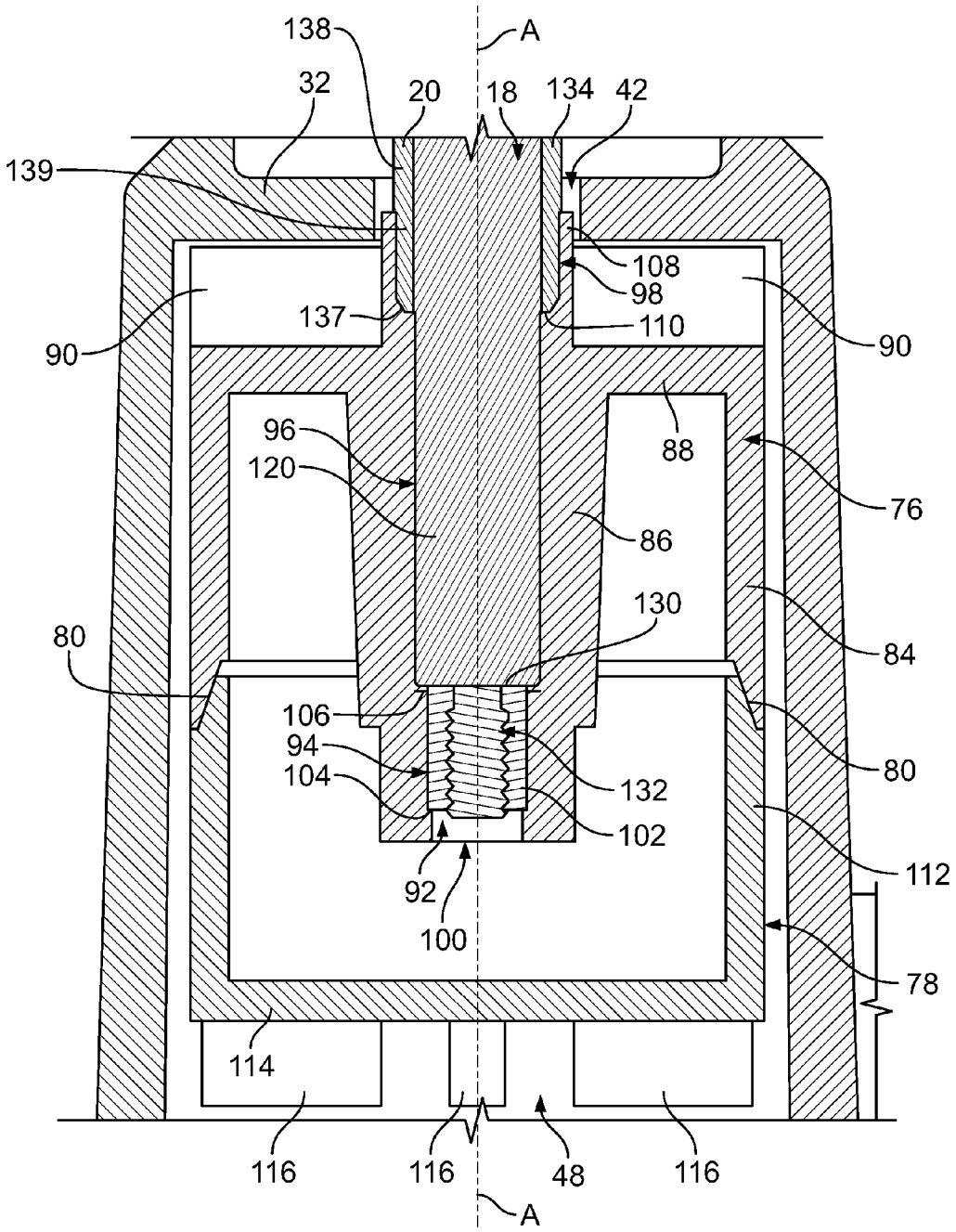
FIG. 5 is a sectional view of the impeller, the impeller housing, the shaft sleeve, and the shaft of FIGS. 1-3 showing an enlargement of area 5 of FIG. 3.
Figure 6:
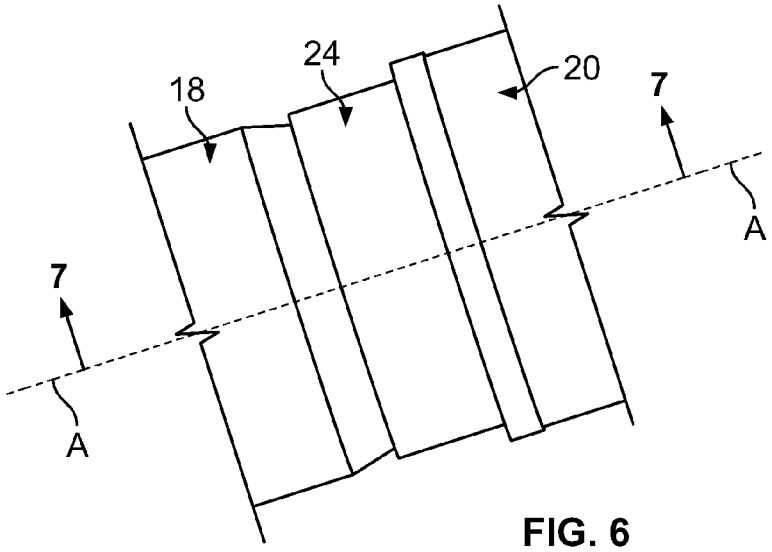
FIG. 6 is a perspective view of the shaft, the shaft sleeve, and the sealing device of FIGS. 1-3 showing an enlargement of area 6 of FIG. 2.

Referring to FIGS. 3 and 5, the impeller 22 includes a first casing 76 and a second casing 78 integrally secured to each other at a junction 80, which may be a friction weld, ultrasonic weld, or any other type of weld as known in the art, for example. Further, the first casing 76 and the second casing 78 may be secured to each other by cement or mechanical fastening. The first casing 76 includes an exterior cylindrical wall 84, an interior cylindrical region 86, a rear wall 88, and rear flutes 90. The interior cylindrical region 86 includes a bore 92, a first counter bore 94, a second counter bore 96, and a third counter bore 98. The bore 92 extends through the entirety of the interior cylindrical region 86 and forms an opening 100 that provides access to the interior of the impeller 22. The first counter bore 94 provides a space for an internally threaded insert 102 to be secured, and further creates a first shoulder 104 at which the internally threaded insert 102 is abuttingly seated. The threaded insert 102 can be a threaded cap, for example. The internally threaded insert 102, which is preferably formed of metal, can be secured within the first counter bore 94 by welding, including friction welding, ultrasonic welding, or other welding processes known in the art. In some embodiments, the threaded insert 102 can be secured in the first counter bore 94 by being molded in place or overmolded by injection molded thermoplastic. In some embodiments, the internal threads can be formed directly in the first counter bore 94, and the threaded insert 102 is not required. The second counter bore 96 extends partially through the interior cylindrical region 86 and forms a second shoulder 106. The third counter bore 98 extends partially through the interior cylindrical region 86 and forms an annular wall 108 and a third shoulder 110. Shoulders 106 and 110 are proximal the shaft 18 and the shaft sleeve 20, which are further discussed below. The second casing 78 includes a cylindrical wall 112, a front wall 114, and front flutes 116. The front flutes 116 are attached to or formed with the exterior of the front wall 114.

Referring to FIGS. 3, and 5-7, the impeller 22 is preferably engaged with the shaft 18 and the shaft sleeve 20. The shaft 18 is preferably cylindrical, extends along axis A, and includes a first end 118 and a second end 120. The geometry of the shaft 18 is not limited to a cylindrical geometry, but may be any one of a plurality of geometries including but not limited to rectilinear, octagonal, or any other contemplated geometry (and the internal negative space of the sleeve 20 and sealing device 24 is preferably made complementary thereto). The shaft 18 is preferably a motor shaft, but may be any type of shaft and is not limited to having an immediate mechanical connection to a motor—there can be a linkage, for example, between the shaft 18 and the motor to which it is in mechanical communication with. The first end 118 can be attached to a motor 12, such that the motor rotates the shaft 18 about axis A, or it can be in communication with the motor 12, such that the motor otherwise induces rotation of the shaft 18. The shaft 18 includes near the first end 118 thereof, a first region 122 having a first diameter D1 that transitions to a second region 124 having a second diameter D2 that is less than D1. In some embodiments, the second region 124 may extend to the second end 120. A tapering region 126 extends between the first region 122 and the second region 124 and includes a sloped wall 128. The sloped wall 128 of the tapering region 126 transitions the first diameter D1 to the second diameter D2. The second end 120 extends to an end wall 130 provided with a threaded extension 132 extending coaxially therefrom. The threaded extension 132 threadably engages the internally threaded insert 102 to form a connection between the shaft 18 and the impeller 22.

During assembly, the impeller 22, by way of the internally threaded insert 102, can be rotated clockwise to threadably attach to the threaded extension 132 via a right-hand thread. When the impeller 22 is fully threaded onto the threaded extension 132, the end wall 130 abuts the second shoulder 106 of the impeller 22. In some embodiments, the motor 12 generally rotates the shaft 18 in a counter-clockwise direction and the counter-clockwise rotation acts to further tighten the impeller 22, retaining its engagement with the shaft 18.

The shaft sleeve 20 includes an elongated body 134 having a first end 136, a second end 138, a bore 140 extending through the ends 136, 138, and a counter bore 142 which defines a shoulder 144. The shaft sleeve 20 geometry complements that of the shaft 18. The second end 138 of the shaft sleeve 20 may be attached to the impeller 22. For example, the second end 138 may be inserted into the third counter bore 98 of the impeller 22 so that it abuts the third shoulder 110. The shaft sleeve second end 138 includes a chamfer 137 at the tip to facilitate insertion into the third counter bore 98 of the impeller. The shaft sleeve second end 138 can have a reduced diameter area 139 that is machined to have a diameter just greater than that of the inner diameter of the impeller annular wall 108, which is compressed when received within the impeller annular wall 108. The second end 138 can then be connected to the first casing 76 of the impeller 22 by a friction weld, ultrasonic weld, or other welding technique or solvent cementing known in the art. Such a connection results in a fluid tight seal and permanent connection between the shaft sleeve 20 and the impeller 22.

The impeller housing 14, end cap 16, shaft sleeve 20, impeller 22, and internally threaded insert 102 may all be constructed of plastic or thermoplastic such as chlorinated polyvinyl chloride (CPVC), polyvinyl chloride (PVC), polypropylene, or other suitable material. Further, these components may be manufactured by any molding or extruding process known in the art. Internally threaded insert 102 may also be a cap constructed from brass, stainless steel, or other metals that can be overmolded into the thermoplastic impeller housing.

Referring to FIGS. 2, 3, and 6-10, a sealing device 24 is positioned between the shaft 18 and the shaft sleeve 20 so as to create a fluid tight seal inhibiting the flow of fluid into the space, if any, between the shaft 18 and the shaft sleeve 20. In preferable embodiments, the sealing device 24 is generally monolithic, e.g., integrally formed. The sealing device 24 includes a first sealing means, e.g., shaft receiving area 150, for forming a seal with a tapering region of the shaft 18, a second sealing means, e.g., shoulder 160, for forming a seal with the shaft sleeve 20 and for enhancing the seal of the first sealing means in response to a force F directed at least in part from the sleeve 20. A circumferential outer wall 146 may be provided for centering the shaft sleeve 20 about the shaft 18 and/or for aligning the force F with the shoulder 160, for example.

The first sealing means can be provided as the shaft receiving area 150, for example. The shaft receiving area 150 includes an inner surface 162.

The second sealing means can be provided as an abutment, which can be of various structures, one such example structure being the annular ring 148 having the shoulder 160. The second sealing means should be configured to allow the shaft 18 to extend therethrough. The diameter of the shoulder 160 is preferably greater than the diameter of the circumferential outer wall 146.

The circumferential outer wall 146 can be configured to have the shaft 18 extend therethrough. In some embodiments, the circumferential outer wall 146 is preferably a cylindrical wall. The circumferential outer wall 146 includes an outer circumferential surface 154, an inner circumferential surface 156, and an end surface 158.

The circumferential outer wall 146, annular ring 148, and shaft receiving area 150 define an opening 152 that accommodates the shaft 18. The geometry of the sealing device 24 is not limited to a cylindrical geometry, but may be any one of a plurality of geometries including but not limited to rectilinear, octagonal, or any other suitable geometry. Importantly, the geometry of the sealing device 24 is preferably complementary of that of the shaft 18 and the shaft sleeve 20 so as to effectuate a proper seal therewith.

The sealing device 24 is designed such that the inner diameter of the inner circumferential surface 156 is slightly greater than the second diameter D2 of the shaft 18, and the diameter of the outer circumferential surface 154 is slightly less than the inner diameter of the counter bore 142 of the shaft sleeve 20. The angle of the inner surface 162 of the shaft receiving area 150 is to complement the angle of the sloped wall 128 of the tapering region 126 of the shaft 18 to effect a seal. For example, the inner surface 162 may be at an angle of fifteen degrees (15°) relative to axis A. This relationship facilitates having the shaft 18 inserted through the sealing device 24 and into the shaft sleeve 20, while the sealing device 24 is inserted into the shaft sleeve 20. The angle of the seal taper, e.g., the angle of inner surface 162, can be different than the angle of the shaft taper, the angle of the sloped wall 128. For example, an angle of the sloped wall 128 of the tapering region 126 of the shaft 18 relative to axis A (e.g., twenty-five degrees (25°)) can be greater than an angle of the inner surface 162 of the receiving area 150 of the sealing device 24 relative to axis A (e.g., twenty degrees (20°)) to force greater outward deflection of the inner surface 162 and the receiving area 150 generally.

Figure 7:
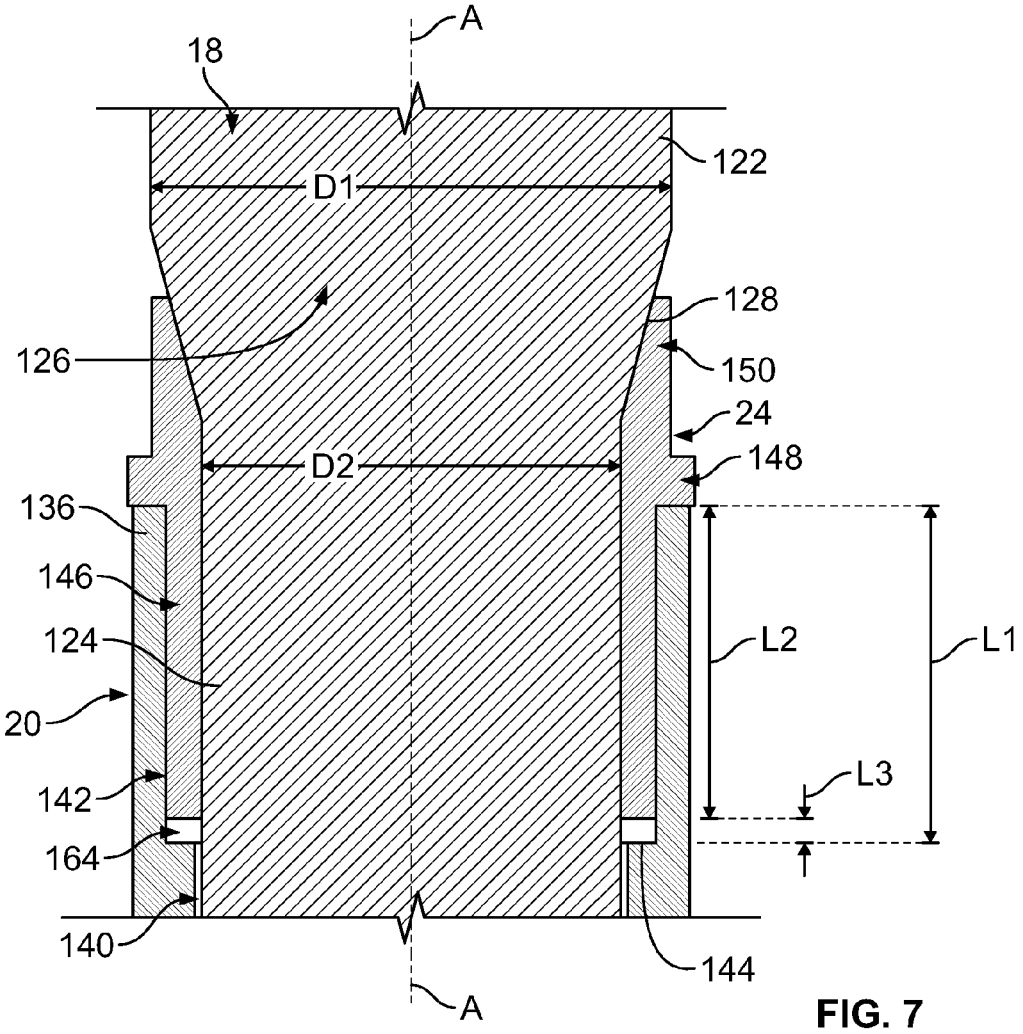
FIG. 7 is a sectional view of the shaft, the shaft sleeve, and the sealing device of FIGS. 1-3 taken along section line 7-7 of FIG. 6.
Figure 8:
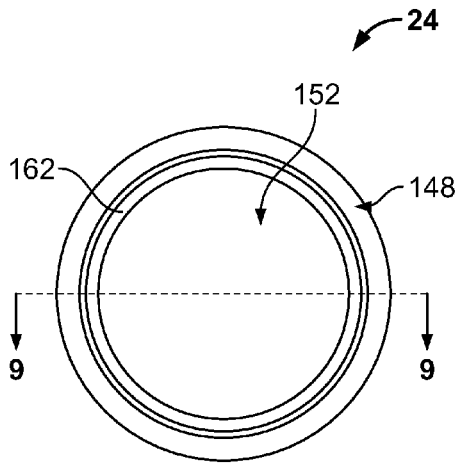
FIG. 8 is a top plan view of the sealing device of FIGS. 1-7.
Figure 9:
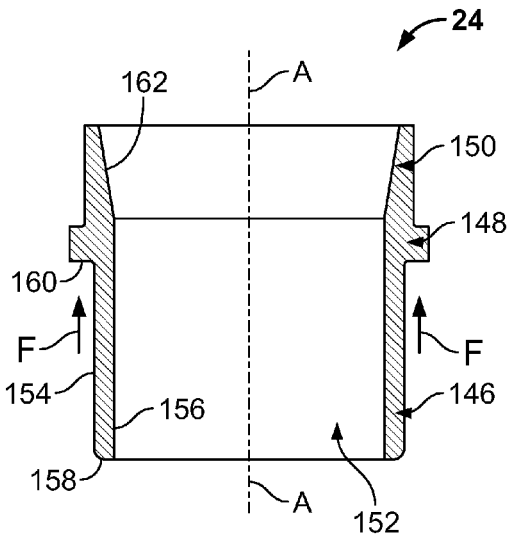
FIG. 9 is a sectional view of the sealing device of FIGS. 1-8 taken along section line 9-9 of FIG. 8.
Figure 10:
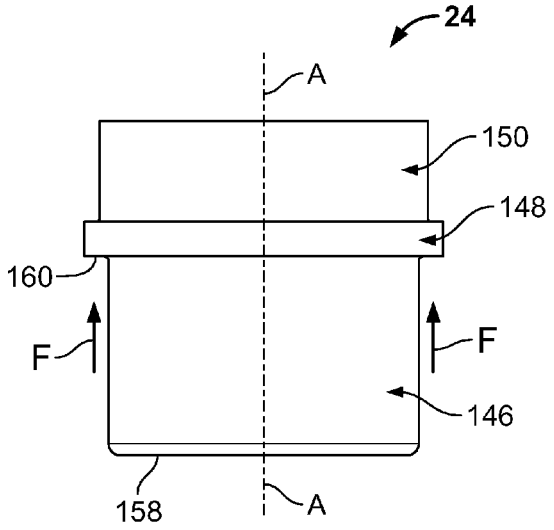
FIG. 10 is an elevational view of the sealing device of FIGS. 1-9.
Figure 11:
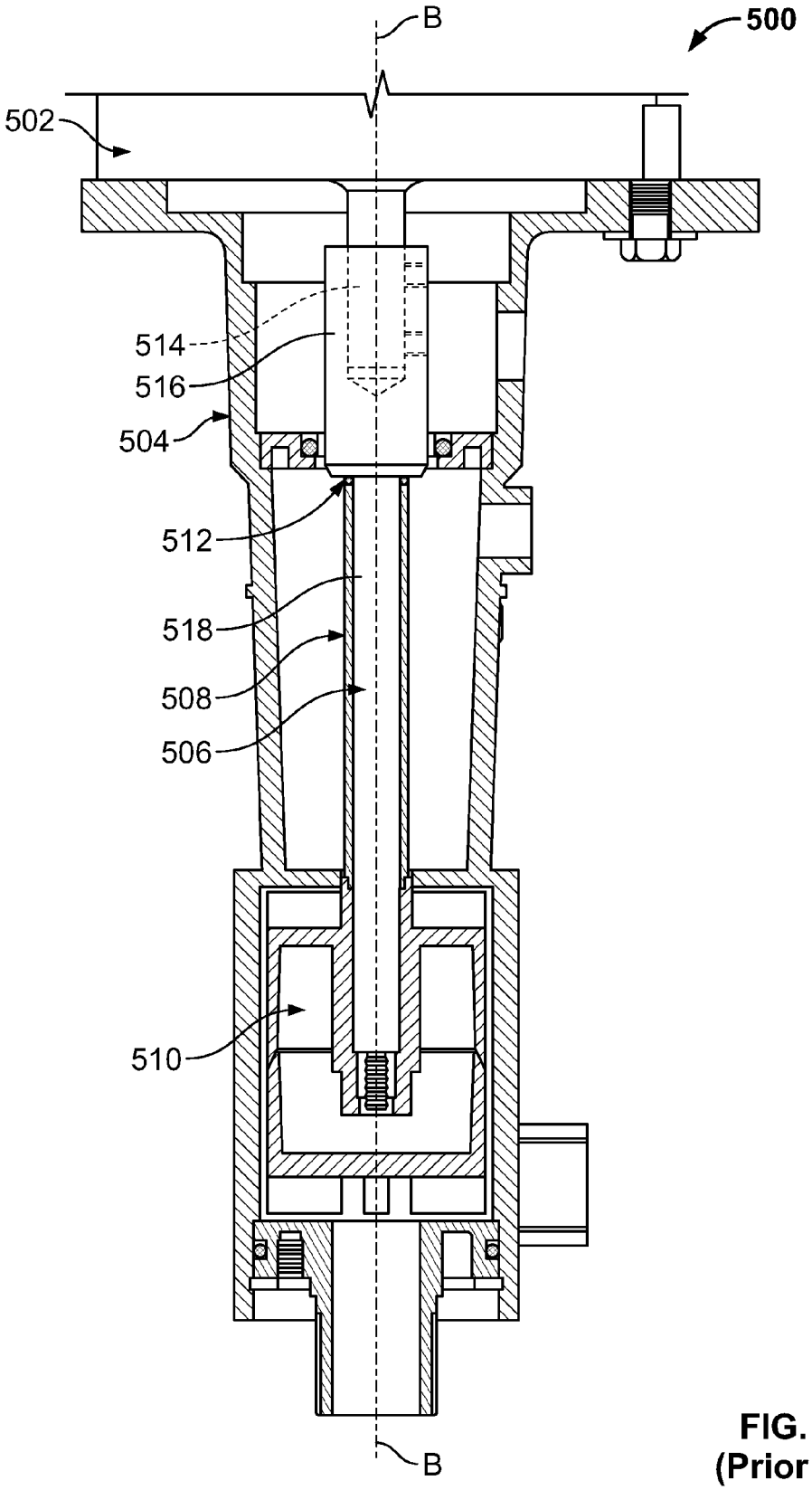
FIG. 11 (Prior Art)
FIG. 11 is a partially-sectioned view of a prior art pump.

As shown in FIG. 7, the combination of the shaft 18, the sealing device 24, and the shaft sleeve 20 form an assembly where the sealing device 24 is sandwiched between the shaft 18 and the shaft sleeve 20. In this example arrangement, the inner circumferential surface 156 of the sealing device 24 forms a slip fit with the surface of the second region 124 of the shaft 18, while the outer circumferential surface 154 of the circumferential outer wall 146 of the sealing device 24 forms an interference fit with the inner surface of the shaft sleeve counter bore 142. This interaction acts to center the first end 136 of the shaft sleeve 20 around the shaft 18. This centering acts to retain the shaft 18, the impeller 22, and the shaft sleeve 20 in a concentric position with each other. Further, the first end 136 of the shaft sleeve 20 engages the annular ring engagement shoulder 160 such that forcing the shaft sleeve 20 over the shaft 18 applies the force F to drive the sealing device 24 toward the first region 122 of the shaft 18 and forces the shaft receiving area inner surface 162 to engage the tapering region sloped wall 128. When these components are engaged, a gap 164 is preferably formed between the end surface 158 of the sealing device 24 and the shoulder 144 of the shaft sleeve 20. As can been seen in FIG. 7, the shaft sleeve counter bore 142 has a length of L1 from the annular ring 148 to the shoulder 144, the sealing device circumferential wall 146 has a length of L2 from the annular ring 148, while the gap 164 has a length of L3, where the relationship is L3=L1−L2. The gap 164 is provided so that the force F applied to the sealing device 24 causes the load to be focused on the shoulder 160 of the annular ring 148. Also, the gap 164 accommodates any deformation that may occur in the sealing device 24 due to the shaft sleeve 20 driving the sealing device 24 into the tapering region 126 of the shaft 18.

The sealing device 24 may be constructed of a thermoplastic such as polytetrafluoroethylene (PTFE), also known as Teflon™, or any other thermoplastic elastomer including high-molecular-weight thermoplastics. The sealing device 24 may be manufactured by molding, injection molding, machining, or any other suitable process known in the art. The sealing device 24, in particular the receiving area 150 thereof, is deformable, e.g., resiliently flexible. As the receiving area 150 is forced toward the first region 122, the receiving area 150 is configured to slightly enlarge, e.g., slightly deform, to have a greater portion of the tapering region 126 positioned therein.

An example method for assembling the immersible pump 10 of FIGS. 1-10 shall now be described with further detail. In some embodiments, the impeller housing 14 is first assembled over the shaft 18, and the end plate 26 is secured to the motor 12. In some embodiments, the shaft 18 can be inserted through the sealing device 24 prior to the attachment of the impeller housing 14.

The impeller 22 is constructed by welding, overmolding, or thermally press fitting the internally threaded insert 102 to the first casing 76 of the impeller 22 at the first counter bore 94. The first casing 76 and the second casing 78 are then welded or solvent cemented together at junction 80. The second end 138 of the shaft sleeve 20 is inserted into the third counter bore 98 of the impeller 22 so that the end engages the third shoulder 110. The shaft sleeve second end 138 is then welded to the annular wall 108 so as to form a permanent fluid tight engagement.

The shaft 18 is then inserted into the first sealing means 150 of the sealing device 24 and through the opening 152. Next, the shaft 18 is inserted into the shaft sleeve bore 140 such that the shaft sleeve 20 engages the sealing device 24 and drives the sealing device 24 toward the shaft tapering region 126. As the shaft sleeve 20 and the impeller 22 combination are pushed to further cover the shaft 18, they are inserted through the division wall through-hole 42. As can be seen in FIG. 5, the components are dimensioned where the through-hole 42 diameter is slightly larger than the outer diameter of the impeller annular wall 108, and the inner diameter of the shaft sleeve second end 138 is slightly larger than the shaft second diameter D2. The shaft sleeve second end 138 includes a chamfer 137 at the tip to facilitate insertion into the third counter bore 98 of the impeller 22. The shaft sleeve second end 138 generally has an outer diameter just greater than the diameter of the impeller annular wall 108, and the shaft sleeve second end 138 can have a reduced diameter area 139 that is machined to have a diameter less than that of the second end 138 generally and still just greater than that of the inner diameter of the impeller annular wall 108. The reduced diameter area 139 is compressed to be received within the annular wall 108.

The shaft 18 is received into the bore 140 of the shaft sleeve 20 until the threaded extension 132 contacts the internally threaded insert 102 that has been welded to or overmolded into the impeller 22. The impeller 22 and shaft sleeve 20 are then rotated clockwise so that the right-hand threads of the threaded extension 132 threadably engage the internal threads of the internally threaded insert 102. Because the shaft 18 is fixedly attached to the motor 12, the threadable engagement of the impeller 22 with the threaded extension 132 causes the impeller 22 and the shaft sleeve 20 to be pulled or driven towards the motor 12. The shaft sleeve 20 applies the force F to the shoulder 160 of the annular ring 148 of the sealing device 24, forcing the sealing device 24 to engage the sloped wall 128 of the shaft 18. This force causes the receiving area 150 of the sealing device 24 to be deformed such that the circumferential outer wall 146 is deformed in a direction toward the gap 164 and the shaft receiving area 150 is deformed radially outward as it is forced along the increasing diameter of the sloped wall 128. This deformation generates a fluid tight seal between the sealing device 24 and the shaft 18, while the force F applied to the shoulder 160 generates a fluid tight seal between the sealing device 24 and the shaft sleeve 20. The impeller 22 may be tightened until it is determined than an adequate seal has been generated, or until the threaded extension 132 is fully threaded into the internally threaded insert 102, at which point the shaft end wall 130 engages the second shoulder 106 restricting further translation.

With the impeller 22 secured to the shaft 18, the end cap 16 can be attached to the immersible pump. The o-ring 72 is placed in the chamber 70 formed by the L-shaped extension 62 extending from the end cap 16. The end cap 16 is inserted into the second portion opening 50 of the impeller housing 14 so that it is housed in the second portion counter bore 52. The end cap 16 is inserted so that the tubular region 58 protrudes from the impeller housing opening 50. Further, the end cap 16 is inserted so that the extension 68 engages the radial shoulder 56, restricting the end cap 16 from being inserted further into the impeller housing 14. When the end cap 16 is fully inserted, the snap ring 74 is snapped into the circumferential recess 54, securing the end cap 16 in place. When the end cap 16 is secured in place, the o-ring 72 is compressed between and engages the L-shaped extension 62 and the inner wall of the counter bore 52, generating a fluid tight seal so that fluid can only enter the impeller housing 14 through the end cap inlet 64.

The immersible pump 10 of the present invention may be provided as a fully assembled device or as a kit for assembly. Further, the immersible pump 10 may be capable of disassembly by a user so that parts can be replaced or removed for maintenance or replacement. If provided as a kit, the immersible pump 10 may be constructed as described above.

In operation, the immersible pump 10 is constructed as previously described and vertically placed in a fluid, such as a corrosive liquid chemical, with the end cap 16 being at the bottom, such that the impeller housing 14 is partially immersed in fluid. A conduit (not shown) can extend into the fluid from the inlet 64. As shown in FIG. 3, the elevation E of the fluid surface is at an intermediate position along the impeller housing 14. The impeller housing 14 is preferably inserted in the fluid with the second portion 30 submerged and elevation E being below the elevation of the drain hole 40. As illustrated, the entire impeller 22 can be submerged so as to effectuate desirable pumping operation.

When the impeller 22 is submerged, the motor 12 is turned on causing the shaft 18 to rotate, which in turn causes the sealing device 24, shaft sleeve 20 and impeller 22 to rotate. The rotation causes the impeller rear flutes 90 and front flutes 116 to change the pressure and force fluid out the outlet 44 and through the hose 46 or pipe to a target location. This change in pressure also pulls water in from the end cap inlet 64 allowing for a continuous pumping operation. During operation, and especially when the motor 12 is turned-off, fluid may enter the second shaft chamber 36 and may commonly splash upwards. It is desirous to restrict fluid from contacting the motor 12 and shaft 18 or entering the space that may exist between the shaft 18 and the shaft sleeve 20. If fluid were to enter the shaft sleeve 20, an imbalance may occur causing the impeller 22 to experience violent vibration and break. Also, fluid such as corrosive liquid chemicals could corrode the metal of the shaft 18. The drain hole 40 provides an escape for any fluid that may build up in the first portion 28 of the impeller housing 14, while the sealing device 24 inhibits fluid from entering the space between the shaft 18 and the shaft sleeve 20.

It will be understood that the embodiments of the present invention described herein are merely exemplary and that a person skilled in the art may make many variations and modifications without departing from the spirit and the scope of the invention. All such variations and modifications, including those discussed above, are intended to be included within the scope of the invention as defined by the appended claims.

What is claimed is:

1. Apparatus for an immersible pump, comprising:

a shaft for communication with a motor, extending along an axis, and including a first region having a first diameter, a second region having a second diameter less than the first diameter, and a tapering region therebetween having a sloped surface relative to the axis;

a sleeve having a bore extending through both ends configured to receive said shaft through said both ends; and a sealing device at least partially positioned between the shaft and the sleeve including: (a) a receiving area, including an inner surface angled relative to the axis, and having said sloped surface of said tapering region of said shaft positionable at least partially within said inner surface to form a seal between said sloped surface and said inner surface, and (b) an abutment configured to form a seal with said sleeve and responsive to a force directed from said sleeve to enhance said seal between said sloped surface and said inner surface.

2. The apparatus of claim 1, wherein said sealing device comprises a circumferential outer wall positionable proximal said sleeve.

3. The apparatus of claim 2, wherein said sealing device comprises an annular ring positioned between said receiving area and said circumferential outer wall and having a radially-extending shoulder that forms said abutment.

4. The apparatus of claim 3, wherein said circumferential outer wall is positionable between said second region and said sleeve.

5. The apparatus of claim 4, wherein said circumferential outer wall is positionable with a gap between said circumferential outer wall and said sleeve so as to direct a load on said sealing device from the force to said shoulder.

6. The apparatus of claim 4, wherein said circumferential outer wall is configured to center said sleeve about said shaft.

7. The apparatus of claim 4, wherein said circumferential outer wall is configured to align the force with said shoulder.

8. The apparatus of claim 1, wherein said shaft has a first end positionable proximal said sealing device in use and a second end opposite thereto, and wherein said sleeve has a first end positionable proximal said sealing device in use and a second end opposite thereto.

9. The apparatus of claim 8, comprising an impeller.

10. The apparatus of claim 9, wherein said impeller is securable to said second end of said shaft against said second end of said sleeve.

11. The apparatus of claim 9, wherein said impeller is securable to said second end of said shaft so as to force said second end of said sleeve in a direction toward said abutment.

12. The apparatus of claim 9, wherein said impeller is threadably engagable with said second end of said shaft so as to force said sleeve in a direction toward said abutment.

13. The apparatus of claim 1, comprising the motor.

14. The apparatus of claim 1 provided as a kit.

15. The apparatus of claim 1, wherein the inner surface is complementary to the sloped surface.

16. The apparatus of claim 1, wherein an angle of the sloped surface relative to the axis is different than an angle of the inner surface relative to the axis.

17. The apparatus of claim 1, wherein at least one of the sloped surface and the inner surface are at an angle with respect to the axis in a range of fifteen to twenty-five degrees.

18. The apparatus of claim 17, wherein the angle is fifteen degrees.

19. The apparatus of claim 1, wherein an angle of the sloped surface relative to the axis is greater than an angle of the inner surface relative to the axis to force greater outward deflection of the inner surface.

20. The apparatus of claim 1, wherein an angle of the sloped surface relative to the axis is twenty-five degrees and an angle of the inner surface relative to the axis is twenty degrees.

21. A method of assembling an immersible pump:

providing a shaft extending along an axis and including a first region having a first diameter, a second region having a second diameter less than the first diameter, and a tapering region therebetween having a sloped surface relative to the axis;

providing a sleeve with a first open end and a second open end opposite the first end;

providing a sealing device including (a) a receiving area having an inner surface angled with respect to the axis and configured to have the sloped surface of the tapering region of said shaft at least partially positioned therein and (b) an abutment;

inserting the shaft into the receiving area of the sealing device;

inserting the shaft through the first and second open ends of the sleeve; and causing the first end of the sleeve to direct a force toward the abutment so as to (a) seal the inner surface of the receiving area with the sloped surface of the tapering region of said shaft at least partially positioned within the sealing device and (b) at least partially seal the sleeve such that the sealing device is at least partially between the shaft and the sleeve.

22. The method of claim 21, wherein causing the first open end of the sleeve to direct the force toward the abutment, comprises forcing the second open end of the sleeve in a direction toward the abutment.

23. The method of claim 22, wherein forcing the second open end of the sleeve in the direction toward the abutment, comprises forcing the second open end of the sleeve in the direction toward the abutment by attaching an impeller to the shaft.

24. The method of claim 23, wherein attaching an impeller to the shaft, comprises threading the impeller to an end of the shaft proximal the second open end of the sleeve.

25. The method of claim 21, wherein providing the sealing device including the receiving area and the abutment, comprises providing the sealing device to include the receiving area, the abutment, and a circumferential outer wall.

26. The method of claim 25, comprising inserting the shaft into the circumferential outer wall.

27. The method of claim 26, comprising positioning the circumferential outer wall between the shaft and the sleeve to center the sleeve about the shaft.

28. The method of claim 26, comprising positioning the circumferential outer wall between the shaft and the sleeve to align the force with the abutment.

29. The method of claim 21, wherein the inner surface is complementary to the sloped surface.

30. The method of claim 21, wherein an angle of the sloped surface relative to the axis is different than an angle of the inner surface relative to the axis.

31. The method of claim 21, wherein at least one of the sloped surface and the inner surface are at an angle with respect to the axis in a range of fifteen to twenty-five degrees.

32. The method of claim 21, wherein the angle is fifteen degrees.

33. The method of claim 21, wherein an angle of the sloped surface relative to the axis is greater than an angle of the inner surface relative to the axis to force greater outward deflection of the inner surface.

34. The Method of claim 21, wherein an angle of the sloped surface relative to the axis is twenty-five degrees and an angle of the inner surface relative to the axis is twenty degrees.

35. Apparatus for an immersible pump comprising:

a shaft for communication with a motor and including a first region having a first diameter, a second region having a second diameter less than the first diameter, and a tapering region therebetween;

a sleeve having a bore through both ends configured to receive said shaft through said both ends; and a sealing device at least partially positioned between the shaft and the sleeve including: (a) a receiving area having said tapering region of said shaft positionable at least partially therein to form a seal therewith, and (b) an abutment configured to form a seal with said sleeve and responsive to a force directed from said sleeve to enhance the seal with said tapering region of said shaft;

wherein said sealing device comprises: (a) a circumferential outer wall positionable proximal said sleeve, and (b) an annular ring positioned between said receiving area and said circumferential outer wall and having a radially-extending shoulder that forms said abutment; and wherein said circumferential outer wall is positionable (a) between said second region and said sleeve, and (b) with a gap between said circumferential outer wall and said sleeve so as to direct a load on said sealing device from the force to said shoulder.

* * * * *